US012693099B2

(12) United States Patent
Vaquer et al.

(10) Patent No.: US 12,693,099 B2
(45) Date of Patent: Jul. 28, 2026

(54) ARCHERY TUNING SYSTEM

(71) Applicant: Archery Intelligence, LLC, Stamford, CT (US)

(72) Inventors: Jordi Vaquer, Tarragona (ES); Josep Lluis Vaquer, Valls (ES); Joan de Magrinya, La Selva del Camp (ES)

(73) Assignee: ARCHERY INTELLIGENCE, LLC, Stamford, CT (US)

( * ) Notice: Subject to any disclaimer, the term of this patent is extended or adjusted under 35 U.S.C. 154(b) by 1128 days.

(21) Appl. No.: 17/631,274

(22) PCT Filed: Jul. 30, 2019

(86) PCT No.: PCT/US2019/044088

§ 371 (c)(1),
(2) Date: Jan. 28, 2022

(87) PCT Pub. No.: WO2021/021123

PCT Pub. Date: Feb. 4, 2021

(65) Prior Publication Data

US 2022/0252380 A1 Aug. 11, 2022

(51) Int. Cl.
*F41J 5/02* (2006.01)
*F41B 5/14* (2006.01)

(52) U.S. Cl.
CPC ..... *F41J 5/02* (2013.01); *F41B 5/1476* (2013.01)

(58) Field of Classification Search
None
See application file for complete search history.

(56) References Cited

U.S. PATENT DOCUMENTS 4,789,932 A 12/1988 Cutler et al.
5,566,951 A 10/1996 Dart et al.
5,871,215 A 2/1999 Butts
6,717,684 B1 * 4/2004 Fikes ..... F41J 5/02 250/221

(Continued)

FOREIGN PATENT DOCUMENTS

CN 205784886 U 12/2016
CN 106123704 A 11/2017

(Continued)

*Primary Examiner* — Sunit Pandya
(74) *Attorney, Agent, or Firm* — Bennet K. Langlotz; Langlotz Patent & Trademark Works, LLC

(57) ABSTRACT

An archery tuning system comprises an archery target facility. The archery target facility has a frame providing an interior perimeter. The archery target facility has an optical sensor facility connected to the frame. The optical sensor facility is adapted to create optical information based on distance measurements from the interior perimeter to an archery projectile present within the interior perimeter of the frame. The archery target facility has a target processor adapted to calculate at least two intersection points of the archery projectile within the interior perimeter of the frame. The at least two intersection points are based on the optical information. The archery target facility has a target transmitter adapted to transmit intersection point information to a receiver. The archery tuning system comprises the receiver. The receiver includes a receiver processor adapted to generate resulting information based on the intersection point information.

20 Claims, 6 Drawing Sheets

(56) References Cited

U.S. PATENT DOCUMENTS

| | | | | |
|---|---|---|---|---|
| 7,985,125 | B2 * | 7/2011 | Kagami | F41J 3/02 463/2 |
| 10,443,987 | B2 * | 10/2019 | Hollinger | F41J 5/10 |
| 11,112,220 | B2 * | 9/2021 | Takamura | F41J 3/0061 |
| 2007/0246887 | A1 * | 10/2007 | Kagami | F41J 3/0042 273/374 |
| 2008/0287229 | A1 | 11/2008 | Donahoe | |
| 2017/0307341 | A1 * | 10/2017 | Hollinger | F41J 5/14 |

FOREIGN PATENT DOCUMENTS

| | | | |
|---|---|---|---|
| DE | 19800441 | C2 | 10/2002 |
| DE | 102016013028 | A1 | 5/2018 |
| KR | 20190057729 | A | 5/2019 |
| WO | 2011085381 | A2 | 7/2011 |
| WO | 2019026856 | A1 | 2/2019 |

* cited by examiner

ARCHERY TUNING SYSTEM

CROSS-REFERENCE TO RELATED APPLICATION

This application is a Nation Phase of International Application No.: PCT/US2019/044088, filed Jul. 30, 2019, which is hereby incorporated by reference in its entirety.

FIELD OF THE PRESENT DISCLOSURE

The present disclosure generally relates to archery tuning. More particularly, the present disclosure relates to systems configured to provide information based on a flight of an archery projectile.

Background of the Present Disclosure

Many existing archery target monitoring devices may not be adapted easily to a plurality of third-party archery targets. Many existing archery target monitoring devices may not be adapted easily to targets in remote locations. Many existing archery target monitoring devices may only be adapted to provide a point of impact on a target. Many existing archery target monitoring devices may not be adapted to provide useful feedback to an archer on how to tune archery equipment and/or improve archer technique.

Many existing archery projectile monitoring devices may not be adapted to determine the stabilization point of an archery projectile during flight. Many existing archery projectile monitoring devices may not be adapted to determine accurate speed of the archery projectile before, during, and after the stabilization point is reached. Many existing archery projectile monitoring devices may not be adapted to determine the flight distance of the archery projectile. Many existing archery projectile monitoring devices may not be adapted to provide useful feedback to an archer on how to tune archery equipment and/or improve archer technique.

Many existing archery bow monitoring devices may not be adapted to monitor position and/or movement immediately before, during, and immediately after the shot of an archery projectile. Many existing archery bow monitoring devices may not be adapted to provide useful feedback to an archer on how to tune archery equipment and/or improve archer technique.

What is needed is an archery tuning system.

SUMMARY OF THE PRESENT DISCLOSURE

At least some embodiments of the present disclosure provide an archery tuning system. The archery tuning system comprises an archery target facility. The archery target facility has a frame providing an interior perimeter. The archery target facility has an optical sensor facility connected to the frame. The optical sensor facility is adapted to create optical information based on distance measurements from the interior perimeter to an archery projectile present within the interior perimeter of the frame. The archery target facility has a target processor adapted to calculate at least two intersection points of the archery projectile within the interior perimeter of the frame. The at least two intersection points are based on the optical information. The archery target facility has a target transmitter adapted to transmit intersection point information to a receiver. The archery tuning system comprises the receiver. The receiver includes a receiver processor adapted to generate resulting information based on the intersection point information.

The target processor may be adapted to calculate a first intersection point of the archery projectile passing through the frame. The target processor may be adapted to calculate a second intersection point of the archery projectile passing through the frame.

The first intersection point may be distinct from the second intersection point.

The target processor may be adapted to calculate an initial intersection point of the archery projectile passing through the frame. The target processor may be adapted to calculate a stationary intersection point of the archery projectile stationary within the frame.

The resulting information may comprise at least one recommendation for an archer. The at least one recommendation may be based on the intersection point information.

The archery tuning system may comprise an indicator connected to the frame. The indicator may be operable to visually display a plurality of different statuses.

The archery tuning system may comprise a target independent from the frame.

The archery tuning system may comprise a target impact sensor connected to the target. The target impact sensor may be adapted to generate target impact information based on a detected impact of the archery projectile on the target.

The archery tuning system may comprise an archery projectile facility. The archery projectile facility may be connected to the archery projectile. The archery projectile facility may have at least one projectile accelerometer. The at least one projectile accelerometer may be operable to generate projectile acceleration information. The archery projectile facility may have a projectile processor operably connected to the at least one projectile accelerometer. The projectile processor may be adapted to process the projectile acceleration information to generate projectile sampled information. The archery projectile facility may have a projectile transmitter operably connected to the projectile processor. The projectile transmitter may be adapted to transmit the projectile sampled information.

The resulting information may include projectile velocity information. The projectile velocity information may be based on the projectile sampled information.

The resulting information may include distance information. The distance information may be based on the projectile sampled information.

The resulting information may include stability information. The stability information may be based on the projectile sampled information.

The resulting information may include projectile impact information. The projectile impact information may be based on the projectile sampled information.

The resulting information may include a flight distance until an impact is detected.

The receiver may include a storage facility including stored data. The receiver processor may be adapted to generate performance information based on the resulting information and based on the stored data.

The stored data may include at least one of arrow shaft mass for a plurality of arrow shafts, fletching mass for a plurality of fletchings, and arrow tip mass for a plurality of arrow tips.

The performance information may include kinetic energy of the archery projectile.

The archery tuning system may comprise an archery bow facility. The archery bow facility may have at least one bow accelerometer operable to generate bow acceleration information. The archery bow facility may have a bow processor operably connected to the at least one bow accelerometer.

The bow processor may be adapted to process the bow acceleration information to generate bow sampled information. The archery bow facility may have a bow transmitter operably connected to the bow processor. The bow transmitter may be adapted to transmit the bow sampled information.

The resulting information may include bow position information. The bow position information may be based on the bow sampled information.

The resulting information may include bow release information. The bow release information may be based on the bow sampled information.

The resulting information may include bow vibration information. The bow vibration information may be based on the bow sampled information.

DETAILED DESCRIPTION

Figure 1A:
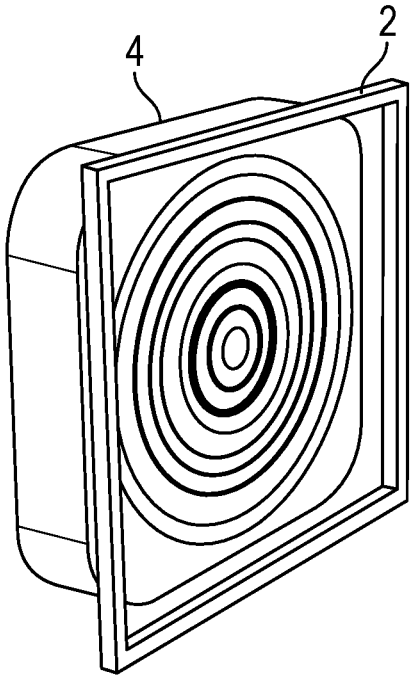
FIGS. 1A and 1B illustrate an example frame and an example target according to various aspects of an embodiment.

Embodiments of the present disclosure now will be described more fully hereinafter with reference to the accompanying drawings, in which embodiments of the present disclosure are shown. This present disclosure may, however, be embodied in many different forms and should not be construed as limited to the embodiments set forth herein; rather, these embodiments are provided so that this disclosure will be thorough and complete, and will fully convey the scope of the present disclosure.

Certain embodiments of the present disclosure include archery projectiles. For the purposes of this disclosure, archery projectiles may include but are not limited to arrows and bolts.

At least some embodiments of the present disclosure provide specific information related to distance measurements of an archery projectile within the frame of an archery target facility. The distance measurements may be employed by a processor to calculate at least two intersection points. The at least two intersection points may be employed by a processor to calculate the location of the archery projectile as it passes through the frame. The at least two intersection points may be employed by a processor to calculate the location of the archery projectile stationary within frame after impact with a target. The at least two intersection points may be employed by a processor to calculate the location of the archery projectile impact on the target. The at least two intersection points may be employed by a processor to calculate the orientation of the archery projectile with respect to the frame. The at least two intersection points may be employed by a processor to calculate the orientation of the archery projectile with respect to the target. In the present disclosure, orientation may include pitch angle and/or yaw angle. Employment of the specific information may increase the likelihood of accurately determining at least a portion of the flight dynamics of the archery projectile. Knowledge of the flight dynamics may be employed by archers seeking to understand how their equipment and or technique effected the flight dynamics of the archery projectile. Knowledge of the flight dynamics may be employed by archery equipment manufacturers and/or dealers seeking to assist archers in equipment selection, equipment setup, and/or technique adjustments. In the present disclosure, resulting information and/or performance information may be based on the flight dynamics. The resulting information and/or performance information may be employed by an archer to improve shot placement, improve consistent shot placement, and/or improve kinetic energy delivered to the target.

According to an embodiment, an archery tuning system may comprise an archery target facility. The archery target facility may comprise a frame providing an interior perimeter. The archery target facility may comprise an optical sensor facility connected to the frame. The optical sensor facility may comprise one or more optical sensors. The one or more optical sensors may be disposed to the interior perimeter. The optical sensor facility may be adapted to create optical information based on distance measurements from the interior perimeter to an archery projectile present within the interior perimeter of the frame. The archery target facility may comprise a target processor adapted to calculate at least two intersection points of the archery projectile within the interior perimeter of the frame. An intersection point may be based on a distance to at least one of the sides of the frame. The sides of the frame may include a left side, a right side, a top side, a bottom side, combinations thereof, and/or the like. The at least two intersection points may be based on the optical information. The archery target facility may comprise a target transmitter adapted to transmit intersection point information. At least one receiver may be adapted to receive the intersection point information. The intersection point information may be based on the at least two intersection points.

Figure 1B:
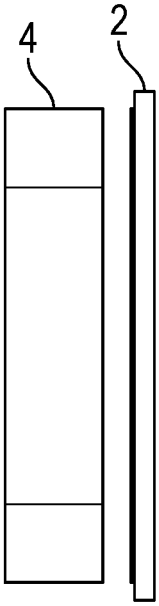

FIGS. 1A and 1B illustrate an example frame 2 and an example target 4 according to various aspects of an embodiment. The frame 2 may be disposed to the target 4. The frame 2 may be configured to be placed in front of the target 4.

Figure 1C:
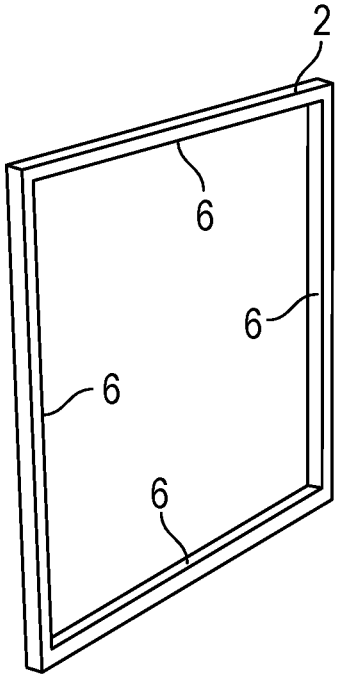
FIG. 1C illustrates an example frame and an example optical sensor facility according to an aspect of an embodiment.

FIG. 1C illustrates an example frame 2 and an example optical sensor facility according to an aspect of an embodiment. The optical sensor facility may comprise one or more optical sensors 6. At least one of a plurality of optical sensors 6 may be located on each of two or more sides of the frame 2.

According to an embodiment, an archery tuning system may comprise a receiver. The receiver may include a receiver processor adapted to generate resulting information based on intersection point information. The resulting information may include a location of an archery projectile with respect to a target. The resulting information may include a location of the archery projectile with respect to a frame. The resulting information may be based on a location of the archery projectile with respect to the target. The resulting information may be based on a location of the archery projectile with respect to the frame. The resulting information may include stability information. The stability information may be based on the orientation of the archery projectile.

According to an embodiment, a target processor may be adapted to calculate a first intersection point of an archery projectile passing through a frame. The target processor may be adapted to calculate a second intersection point of the archery projectile passing through the frame. The frame may not be disposed to a physical target. The frame may be in front of a physical target by a distance greater than or equal to the length of the archery projectile. A virtual target may be projected inside an interior perimeter of the frame.

According to an embodiment, a first intersection point may be distinct from a second intersection point. In this embodiment, an archery projectile may have a pitch angle other than zero and/or a yaw angle other than zero.

According to an embodiment, a target processor may be adapted to calculate an initial intersection point of an archery projectile passing through a frame. The target processor may be adapted to calculate a stationary intersection point of the archery projectile stationary within the frame. The frame may be mounted in front of a physical target. The distance between the frame and the physical target may be less than the length of the archery projectile.

Figure 2B:
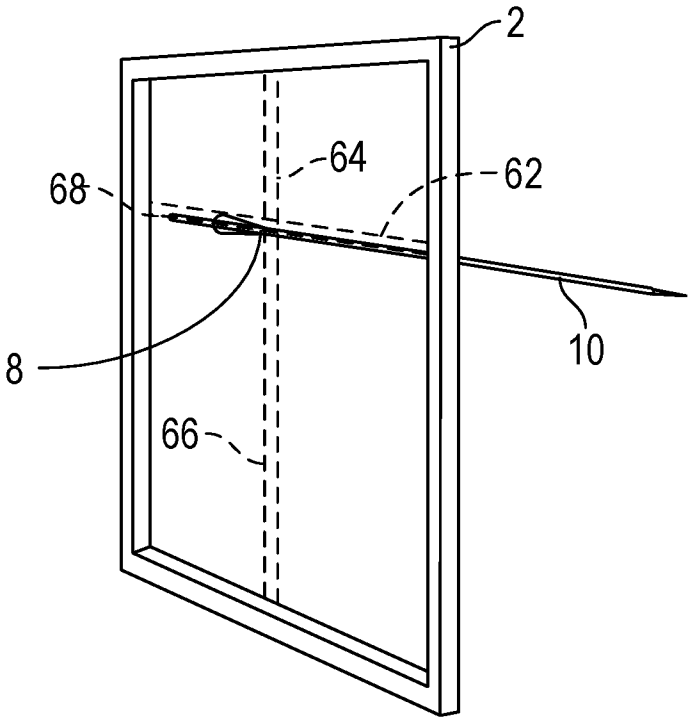
FIG. 2B illustrates an example second intersection point of an example archery projectile according to an aspect of an embodiment.
Figure 2A:
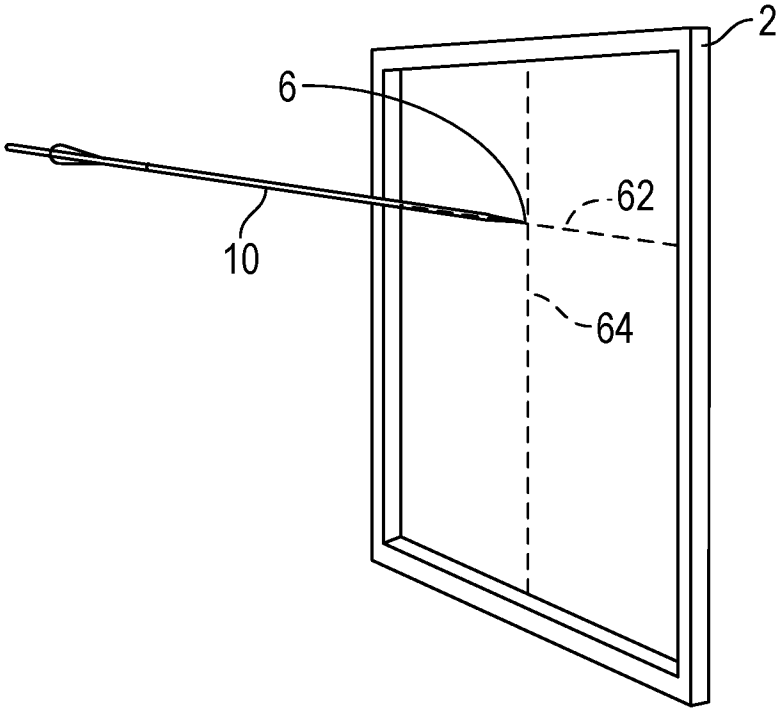
FIG. 2A illustrates an example first intersection point of an example archery projectile according to an aspect of an embodiment.

FIG. 2A illustrates an example first intersection point 6 of an example archery projectile 10 according to an aspect of an embodiment. The first intersection point 6 may comprise a horizontal component 62. The first intersection point 6 may comprise a vertical component 64.

FIG. 2B illustrates an example second intersection point 8 of an example archery projectile 10 according to an aspect of an embodiment. The second intersection point 8 may comprise a horizontal component 68. The second intersection point 8 may comprise a vertical component 66. The second intersection point 8 may be distinct from a first intersection point. The first intersection point may comprise a horizontal component 62. The first intersection point may comprise a vertical component 64. The first intersection point may correspond to distance information to a first portion of the archery projectile 10. The second intersection point 8 may correspond to distance information to a second portion of the archery projectile 10.

According to an embodiment, resulting information may comprise at least one recommendation for an archer. The at least one recommendation may be based on intersection point information.

According to an embodiment, an archery tuning system may comprise an indicator connected to a frame. The indicator may be operable to visually display a plurality of different statuses.

According to an embodiment, an archery tuning system may comprise a target independent from a frame. The target may be a physical target. The target may be a virtual target. The target may comprise a physical component and one or more virtual components.

According to an embodiment, an archery tuning system may comprise a target impact sensor connected to a target. The target impact sensor may be adapted to generate target impact information based on a detected impact of an archery projectile on the target.

According to an embodiment, a receiver may include a storage facility. The receiver may be configured to communicate with the storage facility through employment of a data network (for example, the Internet and/or a Local Area Network). The storage facility may include stored data. A receiver processor may be adapted to generate performance information. The performance information may be based on resulting information and based on the stored data.

Figure 3:
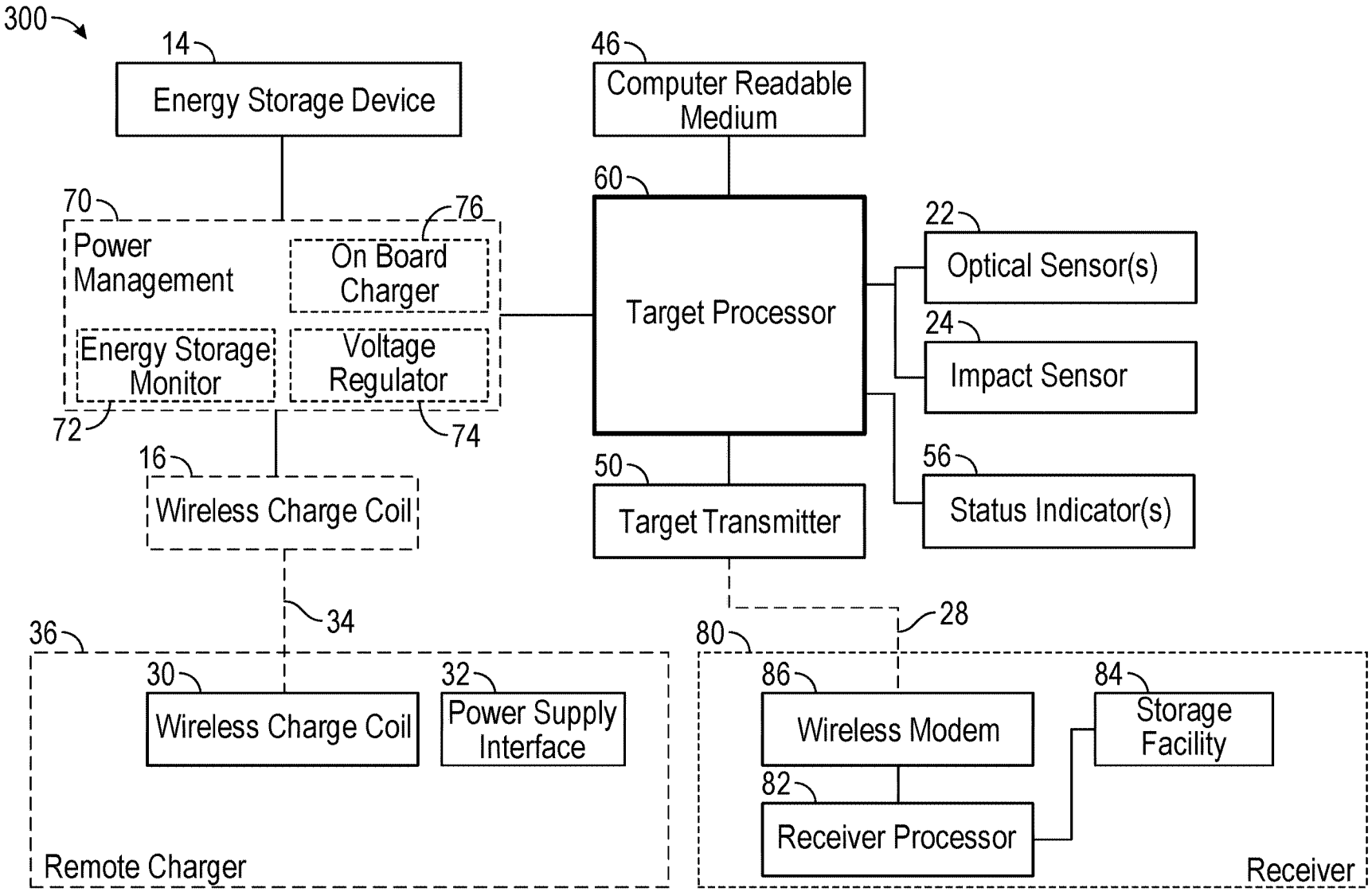
FIG. 3 is a block diagram showing an example archery tuning system according to various aspects of various embodiments.

FIG. 3 is a block diagram showing an example archery tuning system 300 according to various aspects of various embodiments. The archery tuning system 300 may comprise a target processor 60. The archery tuning system 300 may comprise a target transmitter 50. The target transmitter 50 may be in communication with the target processor 60. The archery tuning system 300 may comprise at least optical sensor 22. The at least optical sensor 22 may be in communication with the target processor 60. The archery tuning system 300 may comprise an impact sensor 24. The impact sensor 24 may be configured to read accelerations during an archery projectile impact on a target. The impact sensor 24 may be in communication with the target processor 60. The archery tuning system 300 may comprise at least one status indicator 56. The at least one status indicator 56 may be in communication with the target processor 60. The at least one status indicator 56 may be adapted to correspond to a plurality of states. The at least one status indicator 56 may be presented through employment of at least one LED. The archery tuning system 300 may comprise a computer readable medium 46. The computer readable medium 46 may be in communication with the target processor 60. The archery tuning system 300 may comprise an energy storage device 14. The energy storage device 14 may be in electrical communication with a power management facility 70. The power management facility 70 may comprise an energy storage monitor 72. The power management facility 70 may comprise a voltage regulator 74. The power management facility 70 may comprise an on board charger 76. The energy storage device 14 may be in electrical communication with the target processor 60. The energy storage device 14 may be in electrical communication with the target processor 60 through the power management facility 70. The archery tuning system 300 may comprise a wireless charge coil 16. The wireless charge coil 16 may be in electrical communication with the power management facility 70. The wireless charge coil 16 may be in electrical communication with the energy storage device 14. The wireless charge coil 16 may be adapted to receive energy 34 wirelessly from a remote charger 36. The remote charger 36 may comprise a wireless charge coil 30. The remote charger 36 may comprise a power supply interface 32. The power supply interface 32 may comprise a USB port, a DC socket, a Lightning port, combinations thereof, and/or the like. The archery tuning system 300 may comprise a receiver 80. The receiver 80 may comprise a wireless modem 86. The wireless modem 86 may be adapted to communicate with the transmitter 50 over network 28. The network 28 may, for example, comprise a Bluetooth connection, a ZigBee connection, a Wi-Fi network, or the like. The receiver 80 may comprise a receiver processor 82. The receiver processor 82 may be in communication with the wireless modem 86. The receiver 80 may comprise a storage facility 84. The storage facility 84 may be in communication with the receiver processor 82.

Figure 4:
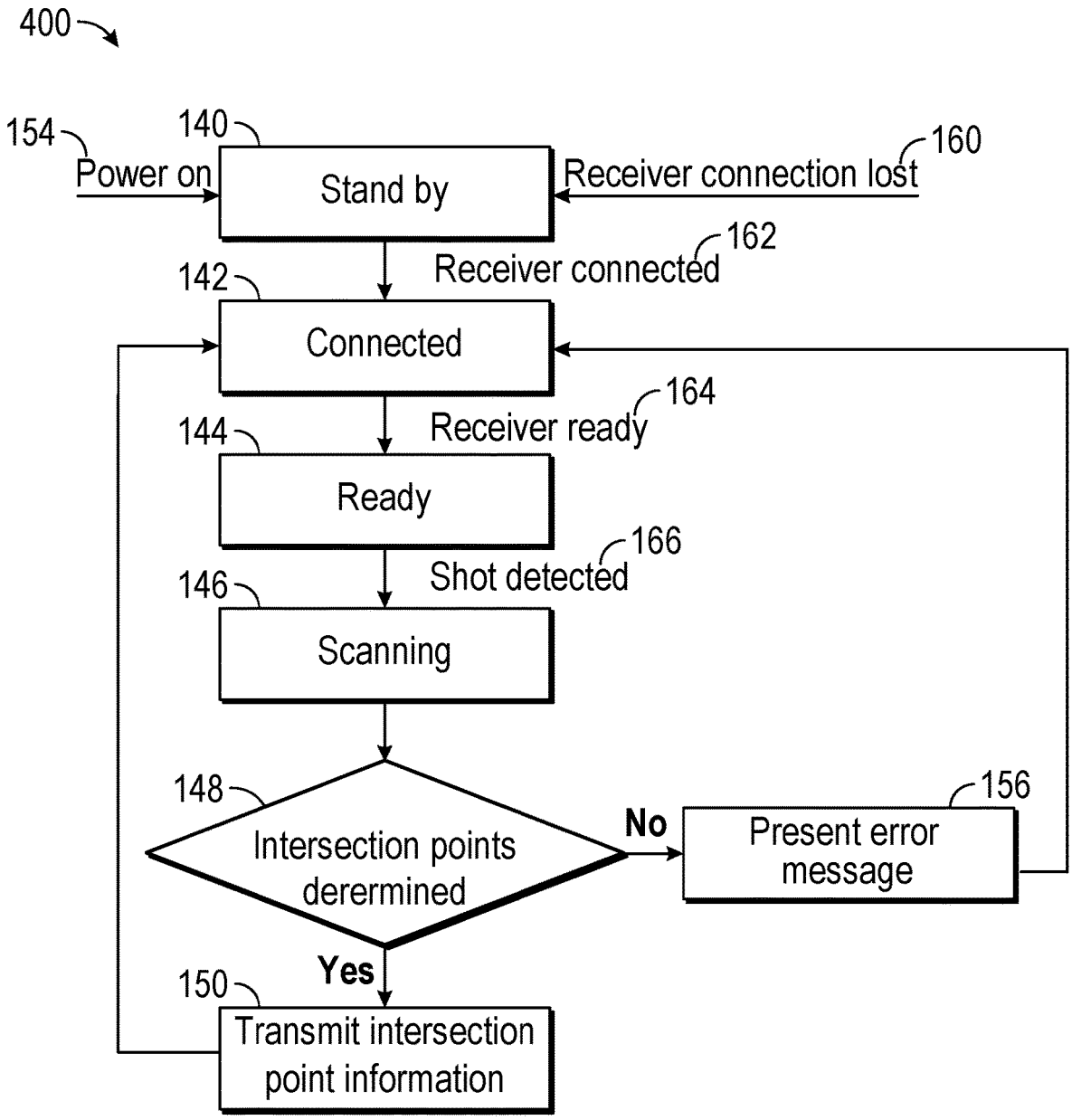
FIG. 4 is a state diagram for an example archery tuning system according to an aspect of an embodiment.

FIG. 4 is a state diagram for an example archery tuning system according to an aspect of an embodiment. The archery tuning system may comprise an archery target facility 400. Upon a power on at 154, the archery target facility 400 may be operable to stand by at 140. Upon a receiver being wirelessly connected at 162, the archery target facility 400 may be operable to be connected at 142. Upon a receiver ready indication at 164, the archery target facility 400 may be operable to be ready at 144. Upon a shot being detected by at least one of an optical sensor facility or an impact sensor at 166, the archery target facility 400 may enter into scanning at 146. After scanning is completed by the optical sensor facility at 146, the archery target facility 400 may be operable to determine intersection points at 148. If intersection points cannot be determined at 148, the archery target facility 400 may be operable to present an error message at 156 and return to connected at 142. The error message may be presented through at least one status indicator. The error message may be transmitted to the receiver. The error message may be presented on a display of the receiver. If intersection points have been successfully determined at 148, the archery target facility 400 may be operable to transmit intersection point information at 150. Once intersection point information has been transmitted at 150, the archery target facility 400 may be operable to return to connected at 142. At any time during operation, if receiver connection is lost at 160, the archery target facility 400 may be operable to return to stand by at 140.

According to an embodiment, an archery tuning system may comprise an archery projectile facility. The archery projectile facility may be connected to an archery projectile. The archery projectile facility may have at least one projectile accelerometer. The at least one projectile accelerometer may be operable to generate projectile acceleration information. The projectile acceleration information may be three-dimensional acceleration information. The three-dimensional acceleration information may comprise instantaneous acceleration along a X axis. The three-dimensional acceleration information may comprise instantaneous acceleration along a Y axis. The three-dimensional acceleration information may comprise instantaneous acceleration along a Z axis. The archery projectile facility may have a projectile processor operably connected to the at least one projectile accelerometer. The projectile processor may be adapted to process the projectile acceleration information to generate projectile sampled information. The archery projectile facility may have a projectile transmitter operably connected to the projectile processor. The projectile transmitter may be adapted to transmit the projectile sampled information. The projectile transmitter may be adapted to transmit a plurality of sequential packets of the projectile sampled information during a flight of the archery projectile. The projectile transmitter may be adapted to transmit at least a portion of the projectile sampled information after an impact with a target has been detected. A receiver may be adapted to receive the projectile sampled information. The receiver may include a receiver processor adapted to generate resulting information based on the projectile sampled information.

According to an embodiment, at least one projectile accelerometer may be a three-axis transducer. The at least one projectile accelerometer may be adapted to detect cyclical flexure of an elongated arrow shaft. The at least one projectile accelerometer may be adapted to detect rotation (commonly referred to as spin) about a body axis defined by the elongated arrow shaft. The at least one projectile accelerometer may be adapted to detect wobble of the elongated arrow shaft. The at least one projectile accelerometer may be adapted to detect fishtailing of the elongated arrow shaft. The at least one projectile accelerometer may be operable to generate three-dimensional acceleration information. The three-dimensional acceleration information may be generated at a rate ranging between 50 and 3200 times per second.

According to an embodiment, processing projectile acceleration information may comprise multiplying the projectile acceleration information by the standard gravity g. Processing the projectile acceleration information may comprise multiplying the projectile acceleration information by the range of a corresponding projectile accelerometer. Processing the projectile acceleration information may comprise dividing the projectile acceleration information by 2 to the power of the number of bits of the corresponding projectile accelerometer. Processing the projectile acceleration information may comprise applying a FIR filter to X axis acceleration components. The FIR filter may employ windowing. Examples of windowing include the Hanning Window, the Hamming Window, and the Blackman window. The FIR filter may, for example, comprise an order of 33. The FIR filter may, for example, comprise a cutoff frequency of 20 Hz.

According to an embodiment, resulting information may include projectile velocity information. The projectile velocity information may be based on projectile sampled information. The projectile velocity information may comprise an average velocity of an archery projectile during at least a portion of flight. The projectile velocity information may comprise a maximum velocity. The projectile velocity information may comprise a minimum velocity. The projectile velocity information may comprise a velocity just prior to detection of an impact. The projectile velocity information may comprise velocity at a specific time during flight. The projectile velocity information may comprise velocity at a specific distance during flight.

According to an embodiment, resulting information may include projectile angle information. The projectile angle information may comprise an angle of the archery projectile during launch. The projectile angle information may comprise an angle of the archery projectile during at least a portion of flight. The projectile angle information may comprise an angle of the archery projectile after impact with a target. The resulting information may include stability information. The stability information may be based on projectile angle information.

According to an embodiment, resulting information may include distance information. The distance information may be based on projectile sampled information. The distance information may comprise a distance travelled by an archery projectile during flight. The resulting information may include projectile impact information. The projectile impact information may be based on projectile sampled information. The distance information may include a flight distance until an impact is detected.

According to an embodiment, projectile sampled information may be based on three-dimensional acceleration information. The three-dimensional acceleration information may comprise instantaneous acceleration in each of X, Y, and Z planes. Resulting information may be based on the projectile sampled information. At least a portion of the resulting information may be based on determination of a stabilization point during a flight of an archery projectile. The stabilization point may be based on the projectile sampled information.

According to an embodiment, resulting information may include projectile stabilization information. The projectile stabilization information may be based on projectile sampled information. The resulting information may include a time interval until the archery projectile reaches a stabilization point. The resulting information may include a flight distance until the archery projectile reaches the stabilization point.

According to an embodiment, a receiver processor may be adapted to generate a first set of resulting information reflecting projectile sampled information over a first time period of flight. The first set of resulting information may be generated for projectile sampled information prior to the stabilization point. The receiver processor may be adapted to generate a second set of resulting information reflecting projectile sampled information over a second time period of flight. The second set of resulting information may be generated for projectile sampled information after the stabilization point. The first set of resulting information may be distinct from the second set of resulting information.

According to an embodiment, a receiver may include a storage facility including stored data. A receiver processor may be adapted to generate performance information based on resulting information and based on the stored data. The stored data may include arrow shaft mass for a plurality of arrow shafts. The stored data may include arrow spine rating for a plurality of arrow shafts. The stored data may include arrow shaft diameter for a plurality of arrow shafts. The stored data may include fletching mass for a plurality of fletchings. The stored data may include a plurality of fletching turn arrangements. The stored data may include a plurality of fletching lengths. The stored data may include a plurality of fletching heights. The stored data may include arrow tip mass for a plurality of arrow tips and/or broadheads. The stored data may include a blade count for a plurality of broadheads. The stored data may include blade size for a plurality of broadheads. The performance information may include kinetic energy delivered to a target. The performance information may include kinetic energy at a specific time during flight. The performance information may include kinetic energy at a specific distance during flight. The performance information may include ballistic information. The performance information may include a ballistic curve. The ballistic curve may be three dimensional. The performance information may include momentum delivered to a target. The performance information may include momentum at a specific time during flight. The performance information may include momentum at a specific distance during flight. The performance information may include impact on target. The impact on target may be expressed in pounds of force per square inch. The performance information may include a flight score. The flight score may comprise a ratio of kinetic energy lost to the total kinetic energy applied at launch. The kinetic energy lost may be calculated at or near a stabilization point. The performance information may include a trauma score. The trauma score may be based on a loss of kinetic energy prior to the archery projectile reaching the stabilization point. The flight score may be expressed as a percentage or a fraction. The flight score may be expressed as a rating in a range of 0-10.

According to an embodiment, an archery tuning system may comprise an archery bow facility. The archery bow facility may have at least one bow accelerometer operable to generate bow acceleration information. The bow acceleration information may be three-dimensional acceleration information. The three-dimensional acceleration information may comprise instantaneous acceleration along a X axis. The three-dimensional acceleration information may comprise instantaneous acceleration along a Y axis. The three-dimensional acceleration information may comprise instantaneous acceleration along a Z axis. The archery bow facility may have a bow processor operably connected to the at least one bow accelerometer. The bow processor may be adapted to process the bow acceleration information to generate bow sampled information. The archery bow facility may have a bow transmitter operably connected to the bow processor. The bow transmitter may be adapted to transmit the bow sampled information. A receiver may be adapted to receive the bow sampled information. The receiver may include a receiver processor adapted to generate resulting information based on the bow sampled information.

According to an embodiment, a bow processor may be adapted to process bow acceleration information to generate bow sampled information. Processing the bow acceleration information may comprise multiplying the bow acceleration information by the standard gravity g. Processing the bow acceleration information may comprise multiplying the bow acceleration information by the range of the corresponding bow accelerometer. Processing the bow acceleration information may comprise dividing the bow acceleration information by 2 to the power of the number of bits of the corresponding bow accelerometer. Processing the bow acceleration information may comprise applying a FIR filter to X axis acceleration components. The FIR filter may employ windowing. Examples of windowing include the Hanning Window, the Hamming Window, and the Blackman window.

According to an embodiment, resulting information may include bow position information. The bow position information may be based on bow sampled information. The bow position information may comprise bow tilt information, bow lean information, bow rotation information, combinations thereof, and/or the like. For the purposes of this disclosure, vertical position may be relative to bow tilt and/or bow lean. Arm drop is an example of bow lean. Bow tilt may also be referred to as bow roll. Bow lean may also be referred to as bow pitch. Bow rotation may also be referred to as bow yaw. An example of bow rotation occurs when the bow body, the string, and the point of aim are not in alignment. Archer posture may be based on bow tilt information, bow lean information, bow rotation information, combinations thereof, and/or the like.

According to an embodiment, resulting information may include bow grip information. The bow grip information may be based on bow sampled information.

According to an embodiment, resulting information may include bow release information. The bow release information may be based on bow sampled information.

According to an embodiment, resulting information may include bow vibration information. The bow vibration information may be based on bow sampled information. The bow vibration information may comprise natural vibrations and/or abnormal vibrations. Natural vibrations may comprise recurrent vibrations. Abnormal vibrations may be caused by, for example, a loose screw and/or a damaged cam. The bow vibration information may comprise bow vibration amplitude, frequency, duration, combinations thereof, and/or the like. Bow vibration information from a shot may be compared to bow vibration information from one or more previous shots.

According to an embodiment, a receiver may include a storage facility. The receiver may be configured to communicate with the storage facility through employment of a data network (for example, the Internet and/or a Local Area Network). The storage facility may include stored data. A receiver processor may be adapted to generate performance information. The performance information may be based on resulting information. The performance information may be based on the stored data. The stored data may include bow mass for a plurality of archery bows. The stored data may include bow length for a plurality of archery bows. The stored data may include bow power for a plurality of archery bows. The stored data may include expected recurring bow vibrations for a plurality of archery bows. Recurring bow vibrations may be based on one or more resonant frequencies of an archery bow. The stored data may include stabilizer mass for a plurality of stabilizers. The stored data may include stabilizer length for a plurality of stabilizers. The stored data may include one or more stabilizer materials for a plurality of stabilizers.

According to an embodiment, performance information may correlate bow vibration information with stabilizer mass, stabilizer length, one or more stabilizer materials, combinations thereof, and/or the like.

According to an embodiment, performance information may include bow efficiency information. Bow efficiency may be based on the amount of energy transferred from the archery bow to an archery projectile. The bow efficiency may be based on a magnitude and/or duration of bow accelerations during a shot burst. A shot burst may include a time interval surrounding the shot of the archery projectile.

According to an embodiment, performance information may include bow fitness information. The bow fitness information may be based on bow vibration information. The bow fitness information may be based on a bow vibration baseline and/or expected bow vibration information.

Figure 5:
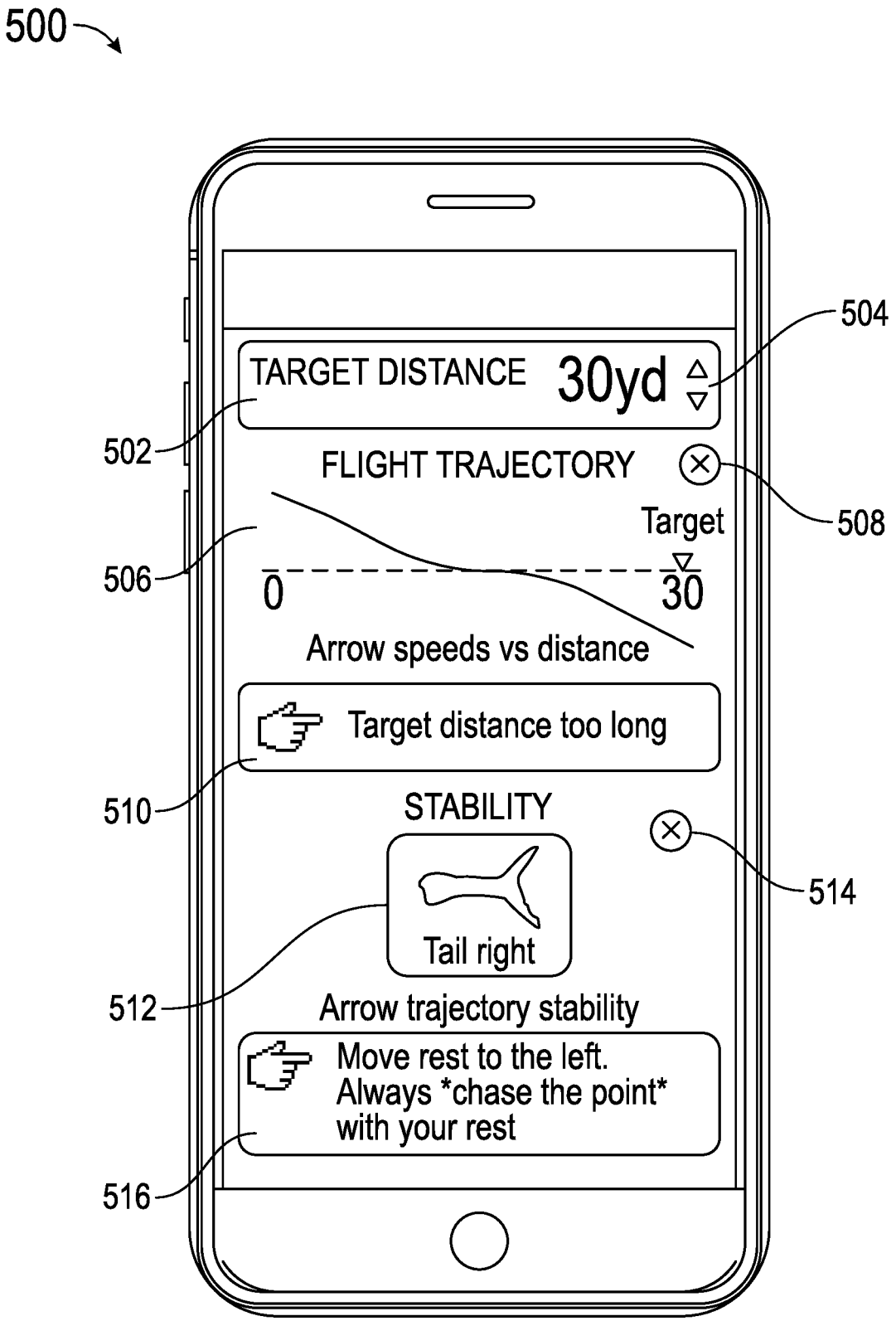
FIG. 5 illustrates an example display of an example receiver according to an aspect of an embodiment.

FIG. 5 illustrates an example display 500 of an example receiver according to an aspect of an embodiment. The display 500 may be in communication with a receiver processor. The display 500 may be configured to present resulting information. The display 500 may be configured to present performance information. The display 500 may be configured to present a target distance 502. The target distance 502 may be based on resulting information. The target distance 502 may be based on projectile sampled information. The target distance 502 may be manually entered by a user. The display 500 may be configured to present a distance adjustment 504. The distance adjustment 504 may be employed by the user for manual adjustments. The display 500 may be configured to present flight trajectory information 506. The flight trajectory information 506 may be based on resulting information. The flight trajectory information 506 may be based on projectile sampled information. The display 500 may be configured to present a flight trajectory status 508. The flight trajectory status 508 may be based on a flight trajectory threshold. The display 500 may be configured to present at least one flight trajectory recommendation 510. The at least one flight trajectory recommendation 510 may be based on resulting information, performance information, intersection point information, projectile sampled information, combinations thereof, and/or the like. The display 500 may be configured to present stability information 512. The stability information 512 may be based on resulting information, performance information, intersection point information, projectile sampled information, combinations thereof, and/or the like. The display 500 may be configured to present a stability status 514. The stability status 514 may be based on a stability threshold. The display 500 may be configured to present at least one flight stability recommendation 516. The at least one stability recommendation 516 may be based on resulting information, performance information, intersection point information, projectile sampled information, combinations thereof, and/or the like.

Figure 6:
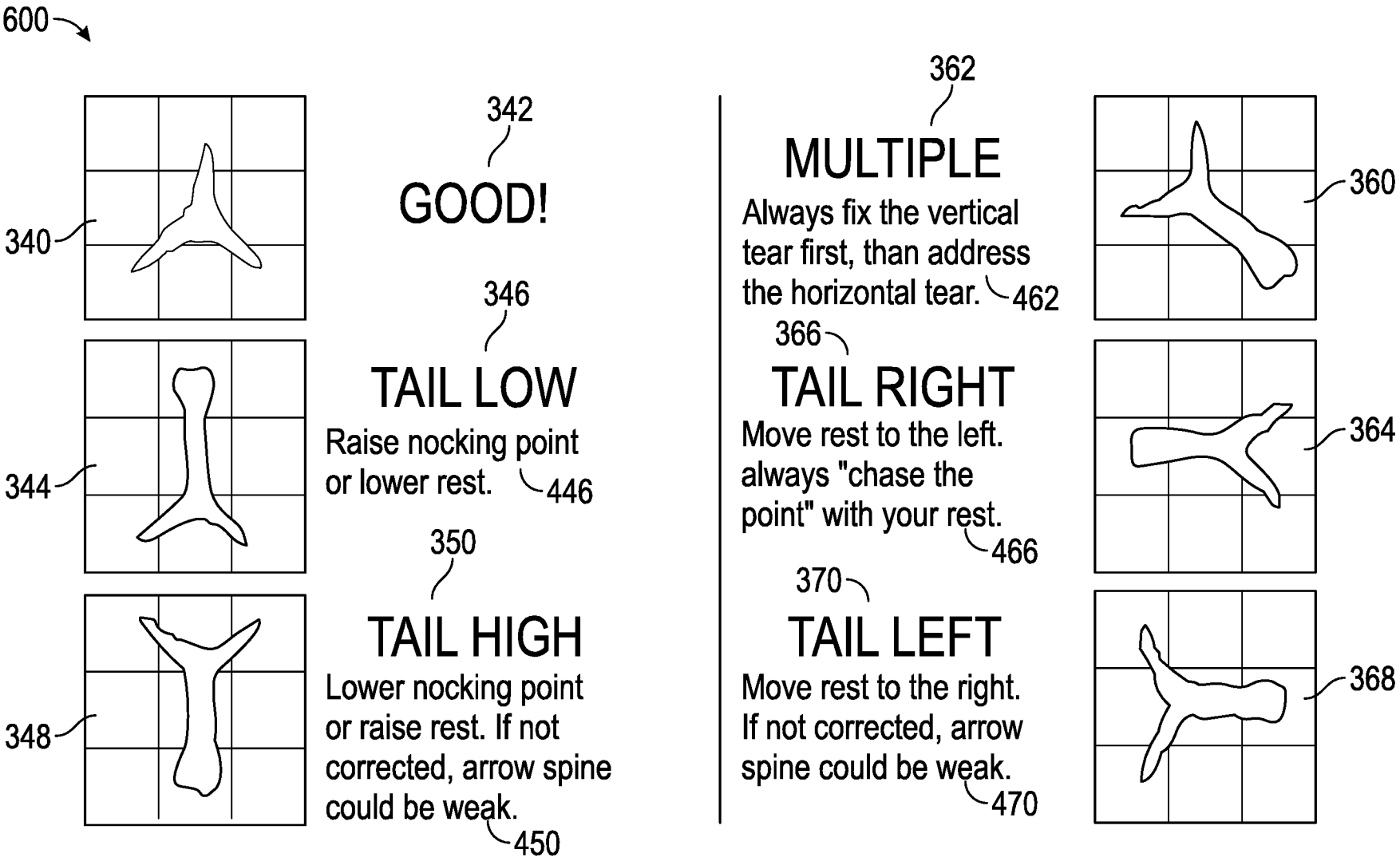
FIG. 6 illustrates example resulting information that may be presented by an example receiver according to an aspect of an embodiment.

FIG. 6 illustrates example resulting information 600 that may be presented by an example receiver according to an aspect of an embodiment. The resulting information 600 may be generated by a receiver processor. The resulting information 600 may be presented on a receiver display. The resulting information 600 may be presented on a display remote from the receiver. The resulting information 600 may comprise projectile angle information (340, 344, 348, 360, 364, and 368). The resulting information 600 may comprise stability information (342, 346, 350, 362, 366, and 370). The resulting information 600 may comprise at least one stability recommendation (446, 450, 462, 466, and 470).

According to an embodiment, resulting information for a first user may be compared to resulting information for a second user. A receiver may be adapted to receive and compare resulting information for a plurality of users. The receiver may be adapted to rank resulting information for a plurality of users. For example, the accuracy and or stability of archery projectiles for each of a plurality of users may be compared and/or ranked. One or more of the plurality of users may be located remotely from the first user. A receiver for each of the plurality of users may be adapted to receive and present resulting information for the other users.

At least some embodiments of the present disclosure provide an archery tuning system. The archery tuning system may comprise an archery target facility. The archery target facility may comprise a frame providing an interior perimeter. The archery target facility may comprise an optical sensor facility connected to the frame. The optical sensor facility may be adapted to create optical information based on distance measurements from the interior perimeter to an archery projectile present within the interior perimeter of the frame. The archery target facility may comprise a target processor adapted to calculate at least two intersection points of the archery projectile within the interior perimeter of the frame. The at least two intersection points may be based on the optical information. The archery target facility may comprise a target transmitter adapted to transmit intersection point information to a receiver. The archery tuning system may comprise the receiver. The receiver may include a receiver processor adapted to generate resulting information based on the intersection point information.

According to an embodiment, a target processor may be adapted to calculate a first intersection point of an archery projectile passing through a frame. The target processor may be adapted to calculate a second intersection point of the archery projectile passing through the frame.

According to an embodiment, a first intersection point may be distinct from a second intersection point.

According to an embodiment, a target processor may be adapted to calculate an initial intersection point of an archery projectile passing through a frame. The target processor may be adapted to calculate a stationary intersection point of the archery projectile stationary within the frame.

According to an embodiment, resulting information may comprise at least one recommendation for an archer. The at least one recommendation may be based on intersection point information.

According to an embodiment, an archery tuning system may comprise an indicator connected to a frame. The indicator may be operable to visually display a plurality of different statuses.

According to an embodiment, an archery tuning system may comprise a target independent from a frame.

According to an embodiment, an archery tuning system may comprise a target impact sensor connected to a target. The target impact sensor may be adapted to generate target impact information based on a detected impact of an archery projectile on the target.

According to an embodiment, an archery tuning system may comprise an archery projectile facility. The archery projectile facility may be connected to an archery projectile. The archery projectile facility may have at least one projectile accelerometer. The at least one projectile accelerometer may be operable to generate projectile acceleration information. The archery projectile facility may have a projectile processor operably connected to the at least one projectile accelerometer. The projectile processor may be adapted to process the projectile acceleration information to generate projectile sampled information. The archery projectile facility may have a projectile transmitter operably connected to the projectile processor. The projectile transmitter may be adapted to transmit the projectile sampled information.

According to an embodiment, resulting information may include projectile velocity information. The projectile velocity information may be based on projectile sampled information.

According to an embodiment, resulting information may include distance information. The distance information may be based on projectile sampled information.

According to an embodiment, resulting information may include stability information. The stability information may be based on projectile sampled information.

According to an embodiment, resulting information may include projectile impact information. The projectile impact information may be based on projectile sampled information.

According to an embodiment, resulting information may include a flight distance until an impact is detected.

According to an embodiment, a receiver may include a storage facility including stored data. A receiver processor may be adapted to generate performance information based on resulting information and based on the stored data.

According to an embodiment, stored data may include at least one of arrow shaft mass for a plurality of arrow shafts, fletching mass for a plurality of fletchings, and arrow tip mass for a plurality of arrow tips.

According to an embodiment, performance information may include kinetic energy of an archery projectile.

According to an embodiment, an archery tuning system may comprise an archery bow facility. The archery bow facility may have at least one bow accelerometer operable to generate bow acceleration information. The archery bow facility may have a bow processor operably connected to the at least one bow accelerometer. The bow processor may be adapted to process the bow acceleration information to generate bow sampled information. The archery bow facility may have a bow transmitter operably connected to the bow processor. The bow transmitter may be adapted to transmit the bow sampled information.

According to an embodiment, resulting information may include bow position information. The bow position information may be based on bow sampled information.

According to an embodiment, resulting information may include bow release information. The bow release information may be based on bow sampled information.

According to an embodiment, resulting information may include bow vibration information. The bow vibration information may be based on bow sampled information.

Various embodiments have been presented. Each of these embodiments may of course include features from other embodiments presented, and embodiments not specifically described may include various features described herein.

A person of ordinary skill in the art will appreciate that components shown in and described with respect to the figures are provided by way of example only. Numerous other configurations are possible. Accordingly, embodiments of the present disclosure should not be construed as being limited to any particular configuration. It will be appreciated that while the disclosure may in certain instances describe a single example embodiment, there may be other configurations, shapes, and orientations of facilities and components without departing from example embodiments of the present disclosure. A person of ordinary skill in the art will recognize the applicability of embodiments of the present disclosure to various archery arrow shafts, bolts, broadheads, tips, fletching, bows, crossbows, targets, and combinations thereof known in the art. A person of ordinary skill in the art may recognize that embodiments of the present disclosure may comprise fabricated, milled, printed, extruded, molded, combinations thereof, and/or the like parts comprising one material or a plurality of materials. A person of ordinary skill in the art will appreciate that components and elements shown in and described with respect to FIGS. 1-6 are provided by way of example only. Numerous other archery projectiles, bows, crossbows, targets, receivers, microchips, and various archery and electrical component configurations are possible. Accordingly, embodiments of the present disclosure should not be construed as being limited to any particular archery projectile, bow, crossbow, target, or archery component. Additionally, it is to be recognized that, while the present disclosure has been described above in terms of various embodiments, it is not limited thereto. Various features, aspects, and/or components of the above described present disclosure may be used individually or jointly. Accordingly, the claims set forth below should be construed in view of the full breadth of the embodiments as disclosed herein.

In this specification, "a" and "an" and similar phrases are to be interpreted as "at least one" and "one or more." References to "a", "an", and "one" are not to be interpreted as "only one". References to "an" embodiment in this disclosure are not necessarily to the same embodiment.

Furthermore, many features presented above are described as being optional through the use of "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a facility described as having three optional features may be embodied in seven different ways, namely with just one of the three possible features, with any two of the three possible features or with all three of the three possible features.

Further, the purpose of the Abstract of the Disclosure is to enable the Patent Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

We claim:

1. An archery tuning system comprising:

an archery target facility, the archery target facility having:

a frame providing an interior perimeter;

an optical sensor facility connected to the frame, the optical sensor facility adapted to create optical information based on distance measurements from the interior perimeter to an archery projectile present within the interior perimeter of the frame;

a target processor adapted to calculate at least two intersection points of the archery projectile within the interior perimeter of the frame, the at least two intersection points based on the optical information;

a target transmitter adapted to transmit intersection point information to a receiver; and the receiver including a receiver processor adapted to generate resulting information based on the intersection point information; and an archery projectile facility, the archery projectile facility connected to the archery projectile and having:

at least one projectile accelerometer operable to generate projectile acceleration information;

a projectile processor operably connected to the at least one projectile accelerometer and adapted to process the projectile acceleration information to generate projectile sampled information; and a projectile transmitter operably connected to the projectile processor and adapted to transmit the projectile sampled information.

2. The system according to claim 1, wherein the target processor is adapted to calculate a first intersection point of the archery projectile passing through the frame, and a second intersection point of the archery projectile passing through the frame.

3. The system according to claim 2, wherein the first intersection point is distinct from the second intersection point.

4. The system according to claim 1, wherein the target processor is adapted to calculate an initial intersection point of the archery projectile passing through the frame, and a stationary intersection point of the archery projectile stationary within the frame.

5. The system according to claim 1, wherein the resulting information comprises at least one recommendation for an archer, the at least one recommendation based on the intersection point information.

6. The system according to claim 1, further comprising an indicator connected to the frame, the indicator operable to visually display a plurality of different statuses.

7. The system according to claim 1, further comprising a target independent from the frame.

8. The system according to claim 7, further comprising a target impact sensor connected to the target and adapted to generate target impact information based on a detected impact of the archery projectile on the target.

9. The system according to claim 1, wherein the resulting information further includes projectile velocity information, the projectile velocity information based on the projectile sampled information.

10. The system according to claim 1, wherein the resulting information further includes distance information, the distance information based on the projectile sampled information.

11. The system according to claim 1, wherein the resulting information further includes stability information, the stability information based on the projectile sampled information.

12. The system according to claim 1, wherein the resulting information further includes projectile impact information, the projectile impact information based on the projectile sampled information.

13. The system according to claim 1, wherein the resulting information includes a flight distance until an impact is detected.

14. The system according to claim 1, wherein the receiver includes a storage facility including stored data, and the receiver processor is further adapted to generate performance information based on the resulting information and based on the stored data.

15. The system according to claim 14, wherein the stored data includes at least one of arrow shaft mass for a plurality of arrow shafts, fletching mass for a plurality of fletchings, and arrow tip mass for a plurality of arrow tips.

16. The system according to claim 14, wherein the performance information includes kinetic energy of the archery projectile.

17. The system according to claim 1, further comprising an archery bow facility, the archery bow facility having:

at least one bow accelerometer operable to generate bow acceleration information;

a bow processor operably connected to the at least one bow accelerometer and adapted to process the bow acceleration information to generate bow sampled information; and a bow transmitter operably connected to the bow processor and adapted to transmit the bow sampled information.

18. The system according to claim 17, wherein the resulting information further includes bow position information, the bow position information based on the bow sampled information.

19. The system according to claim 17, wherein the resulting information further includes bow release information, the bow release information based on the bow sampled information.

20. The system according to claim 17, wherein the resulting information further includes bow vibration information, the bow vibration information based on the bow sampled information.

* * * * *